United States Patent [19]

Kemmel

[11] Patent Number: 4,527,496

[45] Date of Patent: Jul. 9, 1985

[54] SEWING MACHINE WITH A SPOOLING MECHANISM

[75] Inventor: Patrice J. Kemmel, Stutensee, Fed. Rep. of Germany

[73] Assignee: Pfaff Haushaltmaschinen GmbH, Fed. Rep. of Germany

[21] Appl. No.: 580,708

[22] Filed: Feb. 16, 1984

[30] Foreign Application Priority Data

Feb. 22, 1983 [DE] Fed. Rep. of Germany ..... 3306075

[51] Int. Cl.[3] ..... D05B 59/00

[52] U.S. Cl. ..... 112/279; 318/305

[58] Field of Search ..... 112/277, 279; 318/305, 318/345 E

[56] References Cited

U.S. PATENT DOCUMENTS

| | | | |
|---|---|---|---|
| 4,098,206 | 7/1978 | Suchsland et al. | 112/277 X |
| 4,418,809 | 12/1983 | Kornatowski | 112/279 X |
| 4,430,605 | 2/1984 | Arnold | 318/305 X |
| 4,434,880 | 3/1984 | Kornatowski | 112/279 X |

FOREIGN PATENT DOCUMENTS

| | | | |
|---|---|---|---|
| 2840208 | 3/1980 | Fed. Rep. of Germany | 112/277 |
| WO82/03879 | 11/1982 | PCT Int'l Appl. | 112/277 |

*Primary Examiner*—Wm. Carter Reynolds

*Attorney, Agent, or Firm*—McGlew and Tuttle

[57] ABSTRACT

A sewing machine with spooling equipment. For a spooling operation, an armshaft of the sewing machine can be disconnected from a motor drive of the machine. Through a pulse generator for delivering pulses, the armshaft is coupled to a circuit for controlling the speed of the sewing motor. The circuit comprises an operational amplifier designed with a feedback network. To permit an automatic switching of the operational amplifier to regulation or control sewing and spooling, the feedback network of the operational amplifier comprises two resistance members connected in parallel, of which one can be disconnected by a switch which is controlled by the pulse generator. To simplify the switching, the switch is designed as an analog switch whose control line is connected to the output of a control circuit having one end connected to a starter resistor to which the operational amplifier is responsive, and its other input connected to the pulse generator.

5 Claims, 4 Drawing Figures

TRIAC CONTROL
MICRO-COMPUTER
A1
A2
E1
E2
A
B
C
E
M

SEWING MACHINE WITH A SPOOLING MECHANISM

FIELD AND BACKGROUND OF THE INVENTION

The present invention relates in general to sewing machines and in particular to a new and useful sewing machine having a spooling mechanism for winding a spool of thread, the sewing machine having an armshaft connected to a hand wheel by a coupling, and a pulse generator associated with the armshaft for generating pulses corresponding to the speed of the armshaft.

While switching a sewing machine of this kind to spooling, the armshaft and thereby the entire sewing mechanism becomes uncoupled from the sewing motor. The pulse generator coupled to the armshaft is then also uncoupled and no pulses are delivered to the control device of the sewing motor.

A prior art sewing machine therefore comprises a microswitch which is actuated while switching on the spooling mechanism and by which the control device connected between the sewing motor and the control pontentiometer is short circuited. Otherwise, with the sewing mechanism stopped, too low a speed of the sewing motor would be detected and the control device would unduly increase the speed.

This arrangement has the disadvantage that no spooling is possible during a sewing operation. Even with a mistaken switching to spooling during a sewing operation, the sewing motor is under control operation and only a very small piercing force of the needle is obtained and no positioning of the needle is possible.

SUMMARY OF THE INVENTION

The present invention is directed to an arrangement by which, upon switching off the drive of the sewing machine, an automatic switching is effected from the control drive of the sewing motor during a sewing operation to a control of the sewing motor during a spooling operation, depending on the position of the starter.

Accordingly, an object of the present invention is to provide a sewing machine which comprises a sewing motor, a rotary part connected to the motor for rotation, a rotatable armshaft for performing a sewing operation, coupling means connected between the motor and the armshaft for engaging the motor to the armshaft to rotate the armshaft and for disengaging the motor from the armshaft, speed control means connected to the motor for variably controlling the speed of the motor, the speed control means including an operational amplifier having a feedback circuit, a pulse generator associated with the armshaft for generating pulses at a rate proportional to the speed of the armshaft, the pulse generator connected to the speed control means for supplying the pulses to the speed control means, a setting resistor connected to the control device for providing a voltage corresponding to a desired speed of the armshaft and a spooling mechanism engageable with the rotary part which is driven by the sewing motor for spooling a thread. The feedback circuit of the operational amplifier comprises two resistors which are connected in parallel, and a switch connected to at least one of the resistors for disconnecting one of the resistors, the switch being connected to the pulse generator for disconnecting the one resistor. An automatic switching of the motor drive to a proportional control corresponding to the position of the control potentiometer, or to a control depending on the desired speed of the sewing motor is thereby obtained in a simple way. The spooling mechanism may now be used also during a sewing operation.

A further object of the invention is to provide a sewing machine which can switch between a sewing operation and a spooling operation and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

Two embodiments of the invention are shown in the drawings in which:

Referring to the drawings, FIG. 1 shows a part of the housing 1 of the sewing machine, comprising a bearing 2 for an armshaft 3. A coupling member 4 is secured to armshaft 3 by a pin 5. Shaft 3 further carries a handwheel 7 which is loosely mounted thereon through a hub 8, for being driven by a transmission element 6. A coupling member 9 is received in handwheel 7 for radial displacement. For this purpose, coupling member 9 is provided with a slot 10 which is guided laterally on hub 8. Coupling member 9 carries a pin 11 which is urged by a spring 12 against a radially extending guideway 13 of a release disc 14, and a projection 15 which extends through a guide window 16 in handwheel 7 and cooperates with a radially extending locking groove 17 of coupling member 4. Release disc 14 and handwheel 7 are secured against axial displacement by a check screw 18 screwed into the end portion of armshaft 3.

Figure 1:
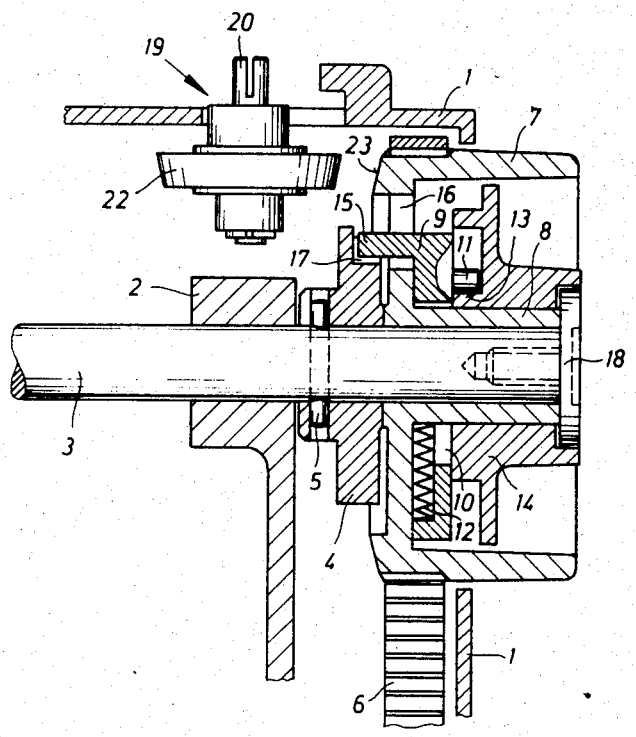
FIG. 1 is a sectional view of a part of a sewing machine showing the handwheel and the spool mechanism.

A spooling mechanism 19, which is switchable on and off, is mounted in housing 1. Spooling mechanism 19 comprises a spooling shaft 20 for receiving a lower thread bobbin, and a drive wheel 22 which can be pivoted along with the entire spooling mechanism 19 against a friction wheel 23 of handwheel 7 in order to wind up a lower thread. In its switched-off state, drive wheel 22 is disengaged from handwheel 7.

To wind up a lower thread, spooling mechanism 19 is pivoted against handwheel 7. Further, release disc 14 is turned relative to handwheel 7, to cause guideway 13 to displace coupling member 9 against the action of spring 12 radially outwardly relative to armshaft 3, and thus to disengage projection 15 from locking groove 17. This disconnects handwheel 7 from armshaft 3, and handwheel 7 now drives only spooling mechanism 19.

Armshaft 3 is then reconnected by turning release disc 14 back relative to handwheel 7. Guideway 13 thereby causes a displacement of projection 15 under the action of spring 12 toward armshaft 3 and the projection applies against the rim of coupling member 4. With handwheel 7 being driven through element 6, projection 15 then slides on the rim of coupling member 4 until it engages locking groove 17, thereby taking armshaft 3 along.

Figures 2, 4:
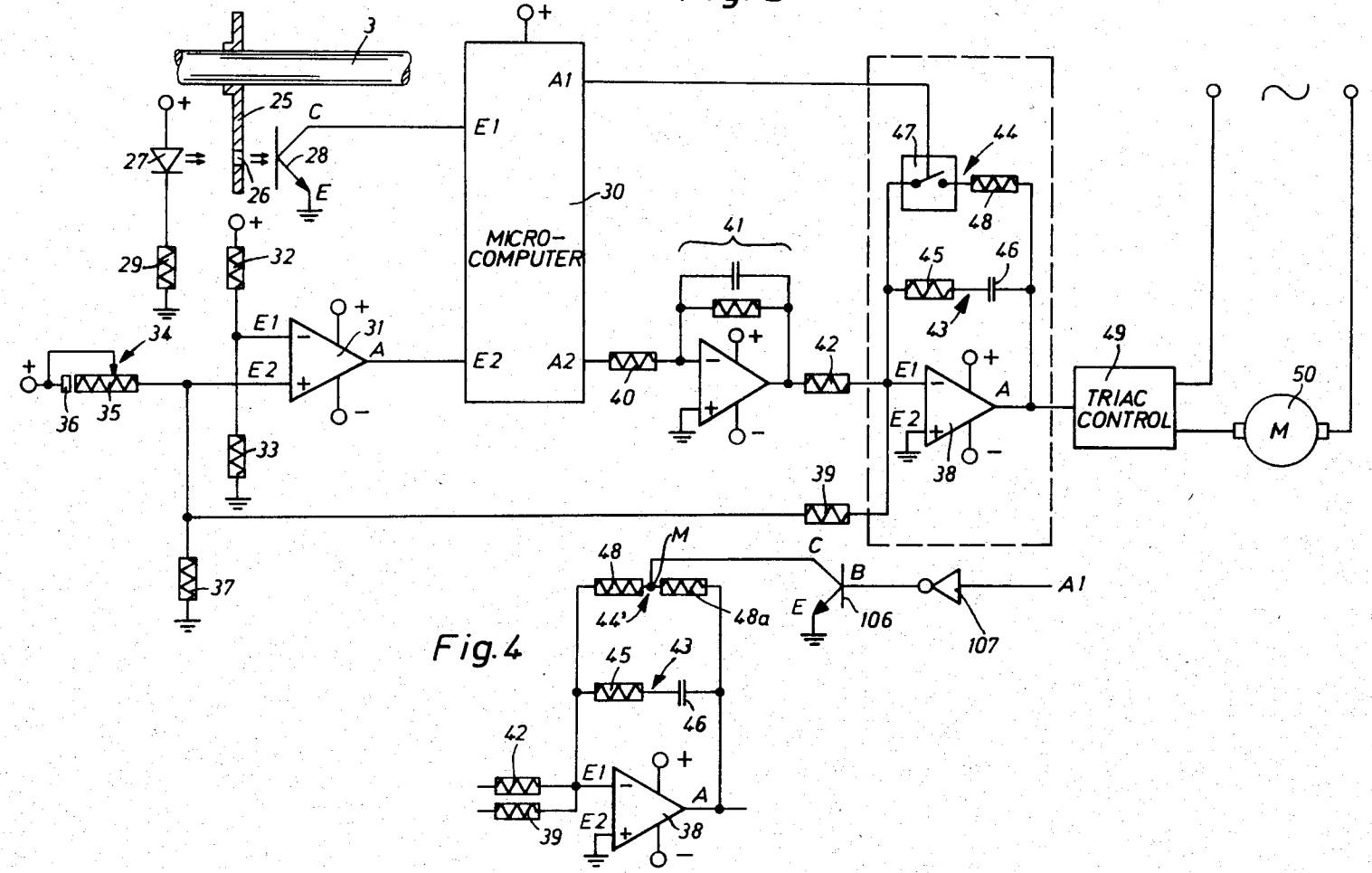
FIG. 2 is a schematic diagram of the control with a microcomputer as the control member.
FIG. 4 shows another manner of connection for the operational amplifier, which is different from that of FIGS. 2 and 3.

FIG. 2 shows an armshaft 3 carrying a pulse generator disc 25 secured thereto. The disc is provided with an aperture 26 cooperating with a light emitting diode 27 and a phototransistor 28. For this purpose, light emitting diode 27 is connected to the positive pole of a stabilized voltage source, and on the other side, through a resistor 29, to ground. The collector C of phototransistor 28 is connected to one input E1 of a microcomputer 30, and the emitter E is grounded.

The output A of a comparator 31 is connected to one input E2 of microcomputer 30, and a reference voltage is applied to the inverting input E1 of the comparator. This voltage is taken from a voltage divider formed by resistors 32 and 33 which are connected between the positive pole of the voltage source and ground.

While aperture 26 passes by, a light beam of light emitting diode 27 falls on the phototransistor which is provided at the other side of pulse generator disc 25.

The non-inverting input E2 of comparator 31 is connected to a starter resistor 34 which comprises a resistor body 35 and a cutoff segment 36 for final switching off, and is connected to the positive pole of the voltage source. Starter resistor 34 is connected as a part of a voltage divider to a ground resistor 37. The junction between starter resistor 34 and resistor 37 is connected to a resistor 39 which, by its other side, is connected to the inverting input E1 of an operational amplifier 38.

One output A2 of microcomputer 30 is connected through a resistor 40, an operational amplifier 41 designed as a lowpass filter, and a resistor 42, to the input E1 of operational amplifier 38 whose non-inverting input E2 is grounded. Operational amplifier 38 is in a feedback network including two resistance members 43,44 which are connected in parallel. Resistance member 43 is formed by a resistor 45 and a capacitor 46 connected in series, and resistance member 44 is formed by an analog switch 47 and a resistor 48, also connected in series.

The control input of analog switch 47 is connected to an output A1 of microcomputer 30. Output A of operational amplifier 38 is connected to the turn-on circuit of a known triac control 49 of a sewing motor 50 for driving the sewing machine through transmission element 6 (see FIG. 1).

The arrangement operates as follows:

Switching on of the power does not yet actuate starter resistor 34 of the sewing machine, and armshaft 3 stands still. Voltage is applied to the control circuit through the positive pole of the voltage source. A low (L) potential is applied to both input E2 and outputs A1 and A2 of microcomputer 30.

Upon actuating starter resistor 34, a voltage drop builds up across resistor 37, which is applied to input E2 of comparator 31 and, through resistor 39, to input E2 of operational amplifier 38. As soon as the voltage across resistor 37 exceeds the reference voltage applied to input E1 of comparator 31 and produced by the voltage divider formed by resistors 32,33, comparator 31 applies a high (H) potential to input E2 of the microcomputer, so that analog switch 47 remains open. Operational amplifier 38 thus operates as a PI (proportional-integral) controller, yet no potential is delivered to input E1 of operational amplifier 38 from output A2 of microcomputer 30. Output A of operational amplifier 38 controls the turn-on circuit of the triac control 49, and sewing motor 50 starts running.

If within a predetermined period of time after the start (about 100 ms), pulses are delivered by phototransistor 28 to input E1 of microcomputer 30, thus if armshaft 3 of the sewing machine is not disengaged from the motor drive, the triac control operation is maintained. Output A2 of microcomputer delivers positive pulses of constant width corresponding to the frequency at input E1 of microcomputer of pulses supplied by the pulse generator (phototransistor 28). These pulses are delivered through resistor 40, operational amplifier 41 where they are integrated and negated, and resistor 42, to the summing point of operational amplifier 38 formed by input E1 to which also the positive reference voltage furnished by starter resistor 34 through resistor 39 is applied. The difference of the two voltages is supplied to operational amplifier 38, for controlling the speed of sewing motor 50 through output A of the amplifier and through the triac control 49.

If no pulses appear at input E1 of microcomputer 30 within the predetermined period of time, such as 100 ms, thus, if the sewing machine is switched to spooling, i.e. armshaft 3 is disconnected, H potential is applied to output A1 and analog switch 47 closes, so that resistor member 43 of operational amplifier 38 is short circuited. Output A2 of microcomputer 30 remains at L potential. The sewing motor 50 is now controlled in proportion to the voltage building up across resistor 37 in response to the adjustment of starter resistor 34, and this voltage is applied to the triac control 49 through operational amplifier 38 which now operates as a proportional amplifier.

Figure 3:
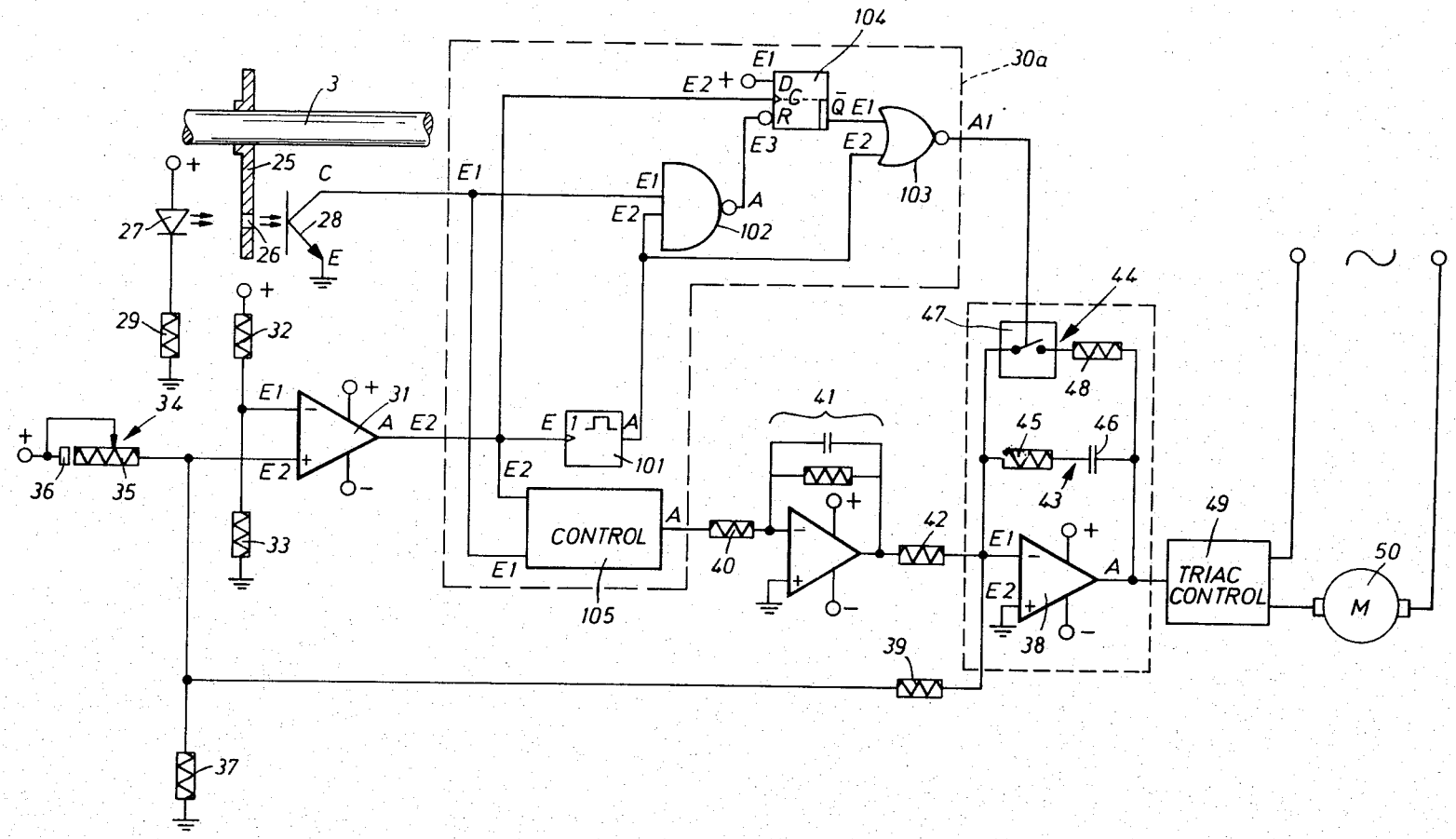
FIG. 3 is a schematic diagram of the control, with a discrete circuit effecting the switching.

In the embodiment illustrated in FIG. 3, microcomputer 30 is replaced by a discrete unit 30*a*, with the other elements of the circuit being the same as according to FIG. 2 and designated by the same reference numerals.

In the embodiment illustrated in FIG. 3, microcomputer 30 is replaced by a discrete unit 30*a*, with the other elements of the circuit being the same as according to FIG. 2 and designed by the same reference numerals.

Circuit unit 30*a* comprises a monostable multivibrator 101 having a pulse width of 100 ms. Input E of multivibrator 101 is connected to output A of comparator 31. Output A of multivibrator 101 is connected to input E2 of a NAND element 102 and to an input E2 of a NOR element 103. Input E1 of NAND element 102 is connected to the collector C of phototransistor 28. Output A of NAND element 102 is connected to a negation reset input E3 of flip-flop 104 having its D input E1 connected to the positive pole of the voltage source and its C input E2 connected to output A of comparator 31. Output $\overline{Q}$ of flip-flop 104 is connected to input E1 of NOR element 103 having its output A1 applied to the control input of analog switch 47. Output A of comparator 31 is connected to an input E2, and the collector of phototransistor 28 is connected to an input E1 of a control 105 for forming the actual value which is connected by its output A to resistor 40.

Upon actuating starter resistor 34, a voltage builds up across resistor 37 by which, upon exceeding the reference voltage, comparator 31 is switched over, so that H potential is applied to monostable multivibrator 101 and to input E2 of flip-flop 104. Therefore, L potential is available at output $\overline{Q}$ of flip-flop 104. H potential is applied both to input E2 of NAND element 102 and to input E2 of NOR element 103. Therefore, L potential is available at output A1 of NOR element 103, and analog switch 47 remains open, so that sewing motor 50 starts under control.

If now within the predetermined period of time of 100 ms, pulses arrive at input E1 of NAND element 102 from phototransistor 28, element 102 switches to L potential at its output A, whereby flip-flop 104 is reset, due to its inverting input E3. H potential appears at output $\overline{Q}$ of element 104. This does not change anything in the state of output A1 of NOR element 103, and analog switch 47 remains open, so that sewing motor 50 continues running under control.

The controlled operation of sewing motor 50 continues even upon output A of monostable multivibrator 101 again assumes L potential after the return time, since this does not switch NAND element 102 nor NOR element 103.

However, if no pulses arrive at input E1 of NAND element 102 within the predetermined pulse width of multivibrator 101, thus if the spooling is switched on and armshaft 3 is disconnected, output A of NAND element 102 remains at H potential and output Q of Flip-flop 104 remains at L potential. Output A1 of NOR element 103 remains at L potential so that even during a spooling operation, analog switch 47 remains open within the pulse of monostable multivibrator 101 and sewing motor 50 starts under control.

After the return time of multivibrator 101 has expired, inputs E2 of NAND element 102 and E2 of NOR element 103 change to L potential. Outputs D of NAND element 102 and $\overline{Q}$ of flip-flop 104 do not change their state. L potential is now applied at inputs E1 and E2 of NOR element 103, so that output A1 of this element switches to H potential and analog switch 47 is closed. This makes resistance member 44 effective and resistor 48 determines the gain of operational amplifier 38 which now operates as a P (proportional) controller.

Another embodiment of the operational amplifier 38 is shown in FIG. 4. In this modification, a resistance member 44' is substituted for member 44, comprising series connected resistors 48 and 48*a*. To the junction therebetween the collector C of a transistor 106 is connected having its emitter grounded. Base B of transistor 106 is connected through a negator or inverter 107 to output A1 of microprocessor 30 if an arrangement according to FIG. 2 is provided, or to output A1 of NOR element 103 if an arrangement according FIG. 3 is considered.

In the operating mode of "spooling", outputs A1 of microcomputer 30 or of NOR element 103 carry H potential so that L potential is applied to the output of inverter 107 and transistor 106 is blocked. Resistors 48 and 48*a* are thus series connected and correspond to resistor 48 of the embodiment of FIG. 2. In this state, operational amplifier 38 works as a P controller.

In the operating mode of "sewing", outputs A1 of microcomputer 30 or of NOR element 103 carry H potential. Therefore, H potential is at the output of inverter 107 and resistor 106 is conducting, so that the junction M between resistors 48 and 48*a* is grounded.

Since both inputs of an operational amplifier in this design are at the same level and input E2 of operational amplifier 38 is grounded, input E1 is grounded too. Resistor 48 is grounded by both its ends, so that it does not produce an effect on input E1 and is as if disconnected. Since the output impedance of operational amplifier 38 is substantially lower than the resistance between output A of operational amplifier 38 and grounded resistor 48*a*, this resistor produces no reactive effect on operational amplifier 38. The gain is thus determined by resistance member 43 and operational amplifier 38 operates as a P1 controller.

While specific embodiments of the invention have been shown and described in detail to illustrate the application of the principles of the invention, it will be understood that the invention may be embodied otherwise without departing from such principles.

What is claimed is:

1. A sewing machine comprising:

a sewing motor;

a rotary part connected to said motor for rotation by said motor;

a rotatable armshaft for performing a sewing operation;

coupling means connected between said motor and said armshaft for engaging said motor to said armshaft to rotate said armshaft and for disengaging said motor from said armshaft;

speed control means connected to said motor for variably controlling the speed of said motor, said speed control means including an operational amplifier having a feedback circuit;

a pulse generator associated with said armshaft for generating pulses at a rate corresponding to an actual speed of said armshaft, said pulse generator connected to said speed control means for supplying said pules to said speed control means;

a starter resistor connected to said control means for providing a voltage corresponding to a desired speed of said armshaft; and a spooling mechanism engageable with said rotary part for spooling a thread;

said feedback circuit of said operational amplifier comprising two resistance members connected in parallel to said operational amplifier and switch means connected to at least one of said resistance members for disconnecting one of said resistance members, said switch means connected to said pulse generator and responsive to said pulse generator for disconnecting said one of said resistance members.

2. A sewing machine according to claim 1, wherein said switch means comprises an analog switch having a control input, said speed control means including a control circuit having a first output (A1) connected to said control input of said analog switch for controlling said analog switch, a first input (E1) connected to said pulse generator and a second input (E2) connected to said starting resistor, said control circuit responsive to a lack of pulses from said pulse generator after a selected period of time to close said analog switch.

3. A sewing machine according to claim 2, wherein said control circuit comprises a microprocessor.

4. A sewing machine according to claim 2, wherein said control circuit comprises a NAND element, a flip-flop, and a NOR element, said flip-flop having an inverting reset input (E3), a dynamic input (E2) and an output (Q), an output of said NAND element connected to said inverting reset input of said flip-flop, one input of said NOR element connected to said output of said flip-flop, said pulse generator connected to one input of said NAND element, said starter resistor connected to a second input of said NAND element, a second input of said NOR element connected to said dynamic input of said flip-flop, and an output of said NOR element connected to a control input of said switching means for switching said switching means.

5. A sewing machine according to claim 4, including a monostable multivibrator connected between said starter resistor and said second input of said NAND element, said multivibrator connected also to said second input of said NOR element.

* * * * *